US009656180B2

(12) United States Patent
Burger

(10) Patent No.: US 9,656,180 B2
(45) Date of Patent: May 23, 2017

(54) WATER AMUSEMENT RIDE HAVING A FLOATING BODY

(71) Applicant: MACK RIDES GMBH & CO. KG, Waldkirch (DE)

(72) Inventor: Guenter Burger, Waldkirch (DE)

(73) Assignee: MACK RIDES GMBH & CO. KG, Waldkirch (DE)

( * ) Notice: Subject to any disclaimer, the term of this patent is extended or adjusted under 35 U.S.C. 154(b) by 0 days.

(21) Appl. No.: 14/653,407

(22) PCT Filed: Jan. 30, 2014

(86) PCT No.: PCT/EP2014/051814

§ 371 (c)(1),
(2) Date: Jun. 22, 2015

(87) PCT Pub. No.: WO2014/122062

PCT Pub. Date: Aug. 14, 2014

(65) Prior Publication Data

US 2015/0306507 A1 Oct. 29, 2015

(30) Foreign Application Priority Data

Feb. 8, 2013 (DE) ..... 10 2013 101 292

(51) Int. Cl.
*A63G 3/02* (2006.01)
*A63G 31/00* (2006.01)
*A63G 3/00* (2006.01)

(52) U.S. Cl.
CPC ..... *A63G 3/00* (2013.01); *A63G 3/02* (2013.01); *A63G 31/007* (2013.01)

(58) Field of Classification Search
CPC ..... A63G 3/00; A63G 3/06; A63G 21/04; A63G 21/08; A63G 31/00; A63G 31/02; A63H 23/10
USPC ..... 472/13, 128, 129; 104/53, 69, 70, 13; 446/153, 161–163
See application file for complete search history.

(56) References Cited

U.S. PATENT DOCUMENTS 1,838,300 A 12/1931 Leonardo
3,967,570 A 7/1976 Bradfield
(Continued)

FOREIGN PATENT DOCUMENTS

CN 102 781 528 A 11/2012
DE 6 940 587 U 10/1969
DE 37 12 611 C1 8/1988
DE 10 2009 053 439 B4 5/2011

OTHER PUBLICATIONS

International search report for related application PCT/EP2014/051814, issued Mar. 24, 2014.
(Continued)

*Primary Examiner* — Kien Nguyen
(74) *Attorney, Agent, or Firm* — Juneau & Mitchell

(57) ABSTRACT

The invention is a water amusement ride, comprising at least one water vehicle, which can be moved in a body of water and which comprises seats for accommodating passengers. A platform is provided, which extends out of the water surface in an idle state of the water amusement ride and is beneath the water surface in an operating state, and a platform carrier is provided, which lifts the platform out of the water surface in the idle state. According to the invention, the platform carrier and/or the platform comprises at least one floating body. The switch to the idle state (and possibly also back to the operating state) can be completed more quickly and with lower force and energy consumption in comparison with a traditional water amusement ride.

14 Claims, 8 Drawing Sheets

(56) References Cited

U.S. PATENT DOCUMENTS

| | | | | |
|---|---|---|---|---|
| 4,149,469 | A | 4/1979 | Bigler | |
| 5,536,210 | A * | 7/1996 | Barber | E04H 4/0006 104/58 |
| 2007/0034130 | A1 | 2/2007 | Dunn | |

OTHER PUBLICATIONS

German Office Action for related application DE 10 2013 101 292.21, issued Sep. 3, 2013.
Chinese Office Action for related application 2014 8000 8027.3, issued Jul. 19, 2016.

* cited by examiner

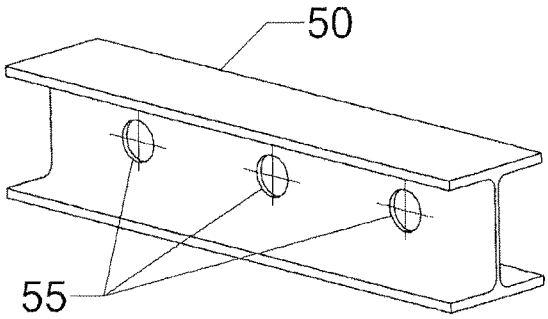
FIG 6
FIG 7
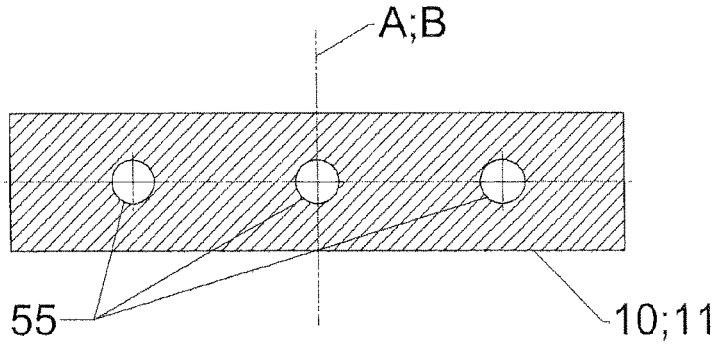
FIG 8
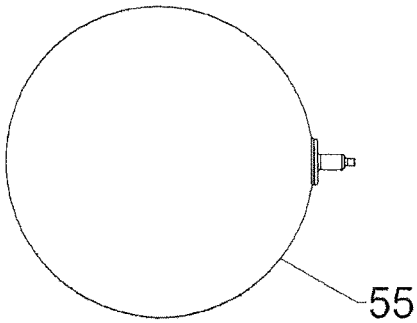

WATER AMUSEMENT RIDE HAVING A FLOATING BODY

CROSS REFERENCE TO RELATED APPLICATIONS

This patent application claims priority to International Patent Application PCT/EP2014/051814, filed on Jan. 30, 2014, and thereby to German Patent Application 10 2013 101 292.2, filed on Feb. 8, 2013.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The invention is a water amusement ride having a floating body.

Background of the Invention

The invention relates to a preferably spinning water amusement ride comprising at least one watercraft, which is moved in a body of water and which comprises at least one seat for accommodating passengers.

Such a water amusement ride is known e.g. from DE 10 2004 062 315 A1. The floating body of a watercraft supported by the water is connected in an articulate fashion to a running gear, which is guided by a rail arranged at the base of the body of water such that it can perform limited lateral and/or lifting motions in reference to the running gear. Here, in one embodiment the running gear is pulled through the body of water via a towing rope guided over deflecting rolls. Accordingly, this water amusement ride represents a water amusement ride equipped with rails, in which the individual watercrafts are moved along the extension of the rail in a type of creek bed.

For such watercrafts tied to rails, DE 10 2006 053 664 B3 describes that a particular floating body is to be provided underneath the watercraft, which is supported rotationally at a frame. At the bottom of the floating body a paddle wheel is arranged connected thereto such that the floating body is set into a rotary motion when traveling through the body of water. The passengers can enter these watercrafts via a particular landing platform at the station of the water amusement ride, with it being mandatory here that the watercrafts dock at said station in a gentle fashion.

Another water amusement ride relying on rails running within a creek or river bed is described in EP 1 671 686 B1. The floating body and the running gear are here connected to each other via coupling elements. The coupling elements ensure that the floating body is fixed after the running gear of the watercraft has lowered.

A spinning water amusement ride, namely a water carousel, is known from CH 183488. This rotating water amusement ride comprises a floating body with seats for accommodating passengers. The floating body is here embodied as an annular, floating bowl, in which seats are arranged for accommodating persons. The annular floating body can here be supported in the water, rotational about a mast or an anchor, and arranged in a rotational fashion about its location of fastening by way of oars or an auxiliary motor. At the external perimeter of the floating body e.g. a diagonal board may be provided, from which the bathers may allow to be slung into the water when the rotation shows sufficient speed. Furthermore, ropes or rings may be provided at the floating body, allowing persons swimming in the water to be pulled along. The access to the seats located in the floating body is provided via a temporary bridge, which the passengers must cross.

Another spinning water amusement ride is known from DE 10 2009 053 439 A1. It discloses the features of the preamble of the present claim 1. In this rotating water amusement ride a circular, large platform is provided, which in the resting state of the water amusement ride projects from the water surface of the body of water and in the operating state is blow the water surface. This way, the passengers can reach their seats in the water amusement ride with dry feet when the water amusement ride is in the idle state.

Preferably several small, circular individual platforms are located on the large, circular platform, which also rotate in reference to each other. The watercrafts are arranged on these small individual platforms also in a rotational fashion. For example, three watercrafts may be placed on each of the individual platforms, which provide seats to accommodate e.g. four passengers. In this rotational water amusement ride it is essential that when the large platform is raised, the individual platforms automatically are lifted as well by suitable coupling elements. When raising the platform with the individual platforms—depending on the size of the rotating water amusement ride—several tons of weight must be axially moved.

The objective of the present invention is to provide a water amusement ride, particularly a spinning water amusement ride, in which a raising of the platform can occur with lesser energy consumption. Another objective is to provide a suitable driving device for the water amusement ride.

BRIEF DESCRIPTION OF THE INVENTION

In a preferred embodiment, a water amusement ride with at least one watercraft, which is mobile in a body of water and which shows space to accommodate passengers, comprising a platform (10), which in the idle state of the water amusement ride is raised above the surface of the water of the body of water and which in the operating state is at least partially below the water surface, and comprises a platform carrier, by which the platform can be lifted above the water surface, wherein the platform carrier and the platform collectively are equipped with at least one buoyancy element or floating body.

2. The water amusement ride of claim 1, wherein the platform (10) is rotational.

3. The water amusement ride of claim 1, wherein the platform carrier has integrated hollow chambers, which serve as buoyancy elements or floating bodies.

4. The water amusement ride of claim 1, further comprising wherein individual platforms are arranged on the platform, which are equipped with additional buoyancy elements or floating bodies.

5. The water amusement ride of one of the previous claims, wherein at least one of the buoyancy elements or floating bodies (55) can be submersed.

6. The water amusement ride of one of the previous claims, wherein at least one of the additional floating bodies is arranged at an individual platform.

7. The water amusement ride of one of the previous claims, wherein the platform carrier is embodied in a stellar or crosswise fashion with the platform carrier arms.

8. The water amusement ride of claim 7, further comprising wherein a drive device is arranged at or in each platform carrier arm at the end.

9. The water amusement ride of claim 8, wherein the drive device is arranged in a hollow chamber of the platform carrier arm.

10. The water amusement ride of claim 1, wherein the water amusement ride comprises an electromotive and/or hydraulic drive device for raising the platform.

11. A drive device for a particular rotary water amusement ride of claim 1, further comprising wherein several drive devices are provided, each of which being arranged at one end of a platform carrier arm of a platform carrier.

12. The drive device of claim 11, wherein the drive devices are each arranged in a hollow chamber of a platform carrier arm at its respective end.

13. The drive device of claim 11, wherein the drive devices are electromechanical or hydraulic drive devices.

BRIEF DESCRIPTION OF THE DRAWINGS

FIGS. 6 and 7 are line drawings evidencing details of illustrations of the platform carrier and a platform and/or an individual platform including the corresponding floating bodies.

FIG. 8 is a line drawing evidencing a special embodiment of a floating body.

DETAILED DESCRIPTION OF THE INVENTION

Figure 1:
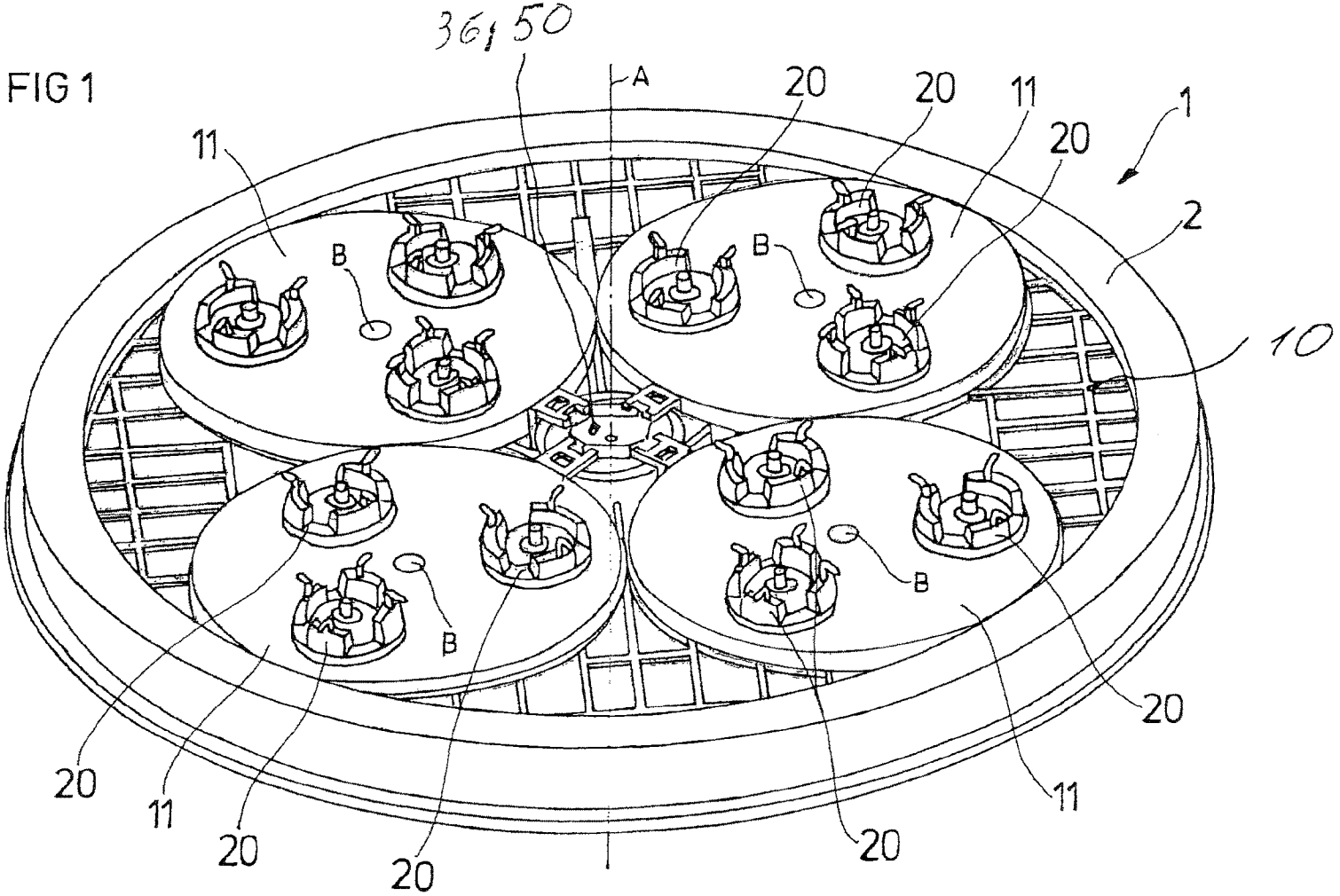
FIGS. 1 to 3 are line drawings evidencing the rotational water amusement ride known from the above-mentioned DE 10 2009 053 439 A1.

The invention is therefore essentially based on designing the platform carriers and/or the platform itself of the water amusement rides known from prior art such that they have at least one floating body. It is known that floating bodies show buoyancy in reference to the surrounding medium, which in the present case is water during the operation of the water amusement ride according to the invention. Thus, less force is required than in conventional water amusement rides for lifting the platform. Consequently, the platform can be raised during the generation of an idle state, thus during the conclusion of the operation, with considerably lesser energy consumption. In such reduced energy consumption the driving devices for raising the platform can be equipped with a lower power output and thus be designed in a lighter and smaller version. Additionally it is possible to faster raise the platform overall, due to the existing floating body in the platform carrier and/or in the platform.

The platform carrier is preferably located in the center of the spinning water amusement ride and is designed in a stellar or crosswise fashion. When using three individual platforms arranged on the large platform, which also rotate, it is recommended to design the platform carrier in a stellar fashion with three platform arms, arranged at an angle of 120° in reference to each other. Furthermore, it is also possible to use any other form for the platform carrier, particularly also a platform carrier with a cross-wise structure, in which the arms are aligned at an angle of 90° in reference to each other. Other forms for the platform carrier are also possible. Hardly any limits are given with regards to the geometric design of the platform carrier. For the platform carrier it is essential that it is coupled to the platform and/or is connected thereto and it is possible to raise and lower the platform.

According to the present invention it is given that this platform carrier and/or the platform itself are equipped with at least one, preferably several floating bodies, so-called pontoons, or generally called buoyancy bodies or floating elements. In the simplest case, these floating bodies may be integrated in the existing platform carrier, preferably made from metal, as hollow walls or troughs.

In one exemplary embodiment it is possible e.g. that a plurality of hollow bodies, thus floating bodies, is integrated in a cross-wise platform carrier. Here, it is also possible that the floating bodies and/or the hollow bodies in the platform carrier are partially flooded with water, if so desired, in order to allow adjusting the intended buoyancy in a targeted fashion based on the use of a floating body in the platform carrier.

It is also within the scope of the invention to place an electromotive or also a hydraulic driving device in one of the hollow bodies of the platform carrier in order, on the one hand, to allow raising the platform and, on the other hand, setting into rotation the platform and any potentially present individual platforms.

In one further development of the invention it is provided that a floating body is integrated not only in the platform carrier or in the platform or said part carries a floating body. Rather it is also possible that such floating bodies are arranged on or in the individual platforms, i.e. integrated therein. If so desired, these floating bodies may also be partially flooded with water in order to adjust the desired buoyancy in a targeted fashion.

It is also within the scope of the invention to embody the platform in several parts, with the platform being able to rotate. It has also proven beneficial e.g. to place several smaller circular, also rotating individual platforms on a preferably circular platform. Here, both the large platform as well as the individual platforms may be set into rotation. When raising the platform the individual platforms are automatically entrained via suitable coupling elements.

In other embodiments of the invention the platform shows at least one additional floating body and/or the individual platforms each show at least one additional floating body. Due to the fact that these additional floating bodies also generate buoyancies, they amplify the buoyancy provided by the platform carriers according to the invention or by floating bodies and/or buoyancy elements provided in the platform.

Detailed Description of the Figures

For an easier understanding of the present invention, FIG. 1 shows an example of a rotational water amusement ride known from the above-mentioned DE 10 2009 053 439 A1 in a perspective illustration. The water amusement ride is generally marked with the reference character 1. The water amusement ride 1 shows a circular exterior contour with a frame 2. A rotary platform 10 is located within this frame 2, which extends almost to the frame 2 of the water amusement ride 1. This platform 10 is embodied as a rotary disk and can spin about the central axis A, for example in the clockwise direction. On and/or within this platform 10 and/or this rotary disk several (in the exemplary embodiment shown, four) individual platforms 11 are located, which are also arranged rotationally about their respective axis. The axes of rotation of the individual platforms 11 are marked with the reference character B. As discernible, the individual platforms 11 are in turn embodied as rotary disks. By suitable driving means these individual platforms 11 rotate, preferably in the opposite direction in reference to the platform 10, here thus for example in the counter-clockwise direction.

The individual platforms 11 hold several watercrafts 20. Such watercrafts are known per se, for example from DE 10 2006 053 664 B3 mentioned at the outset. These watercrafts 20 are placed distributed over the individual platforms 11 and can also rotate about their respective axis.

Figure 2:
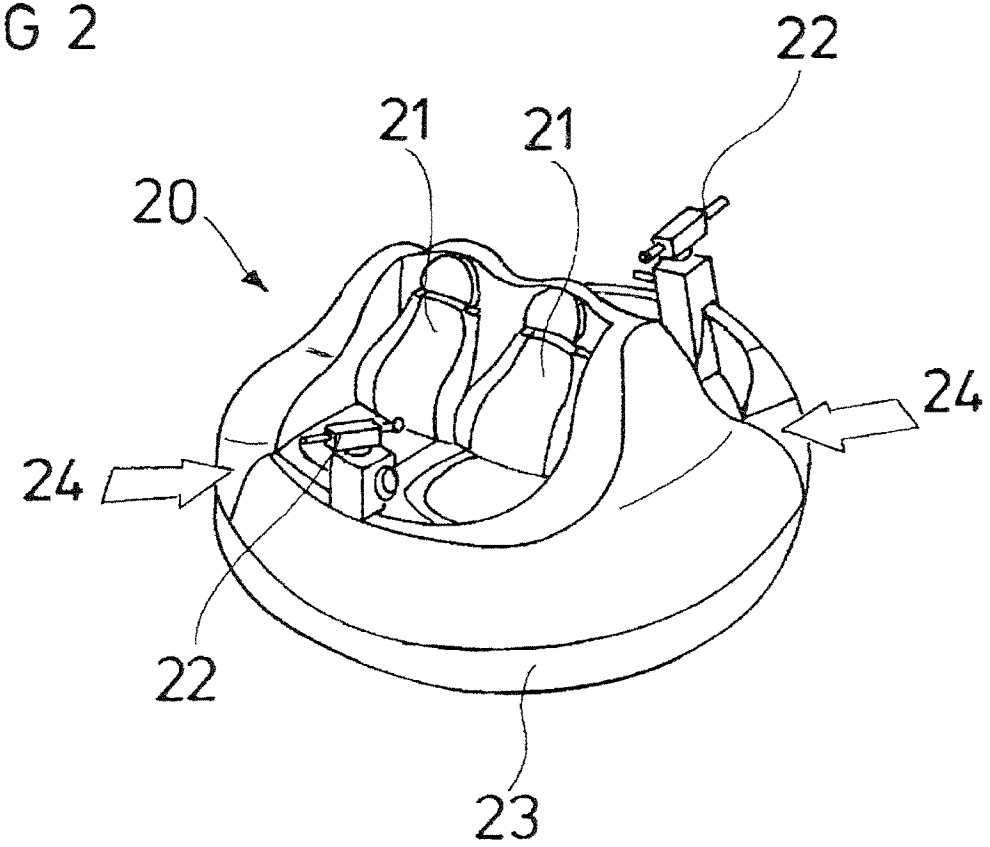

FIG. 2 shows an example of a suitable watercraft. The watercraft comprises a suitable floating body 23, on which several seats 21 for passengers are arranged. In order to increase the fun in riding and playing these watercrafts 20 may be equipped with spray guns 22. Beneficially the watercrafts 20 show a circumferential frame, in which recesses 24 are inserted in order to facilitate passengers entering and leaving the watercraft 20.

During operation of the ride, i.e. in case of a rotating platform 10 as well as also rotating individual platforms 11 and preferably also rotating watercrafts 20, the water amusement ride 1 is filled inside the frame 2 with water to such a level that only the watercrafts 20 with their seats 21 project above the water surface. The passengers therefore are given the impression that the individual watercrafts 20 float on the water surface and no additional fastening elements are present.

However, in order to allow the passengers to reach the individual watercrafts 20 without getting their feet wet, means are provided which in the idle state of the water amusement ride, i.e. when neither the platform 10 nor the rotational individual platforms 11 spin any longer, the water level lies underneath the platform 10 and underneath the individual platforms 11. This can be achieved either by the water present in the water amusement ride 1 being drained to such an extent that the water level falls below the platform 10 and/or the individual platform 11. However, a suitable lifting device may also be provided, which hoists the platform 10 via suitable coupling elements together with the individual platforms 11 and the here provided watercrafts 20 above the water level, and for operation of the water amusement ride lowers it again.

Figure 3:
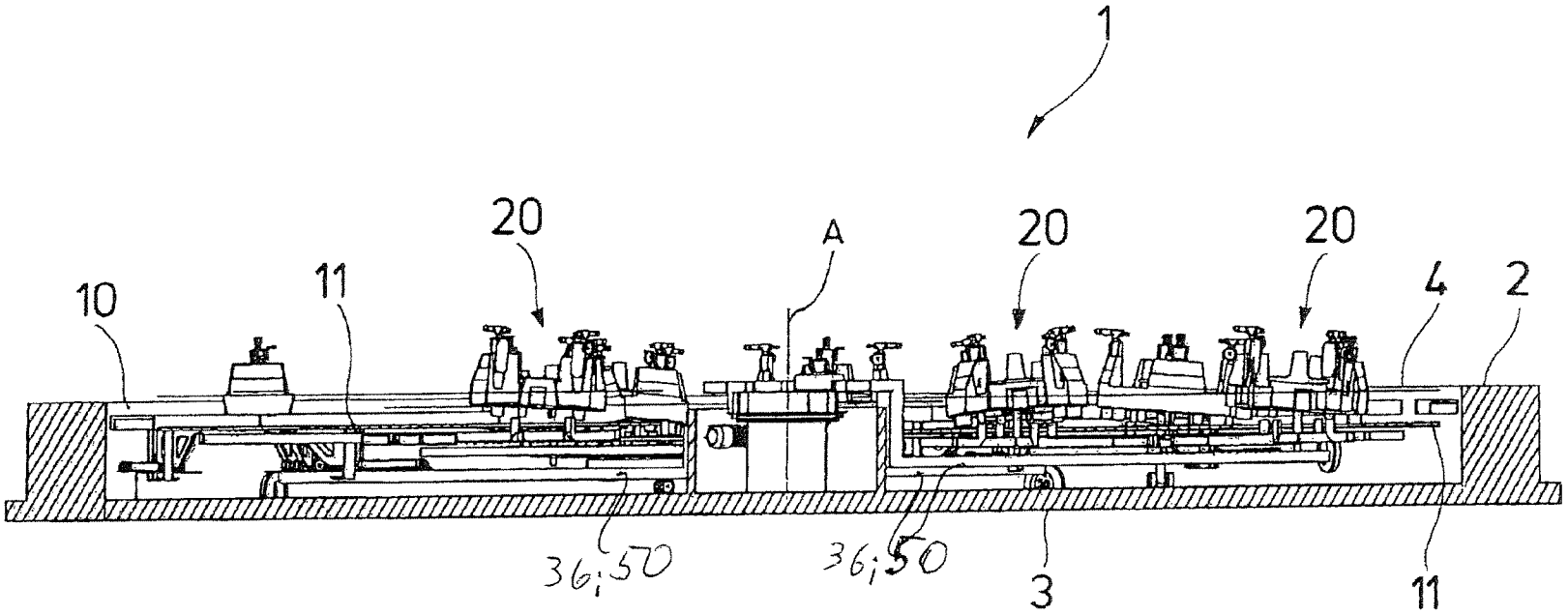

FIG. 3 shows the rotational water amusement ride of FIG. 1 in a cross-section, with the water level 4 being above the platform and above the individual platforms 11. To the extent the water level 4 is above the platform 10 and the individual platform 11, the water amusement ride is ready for the operating state, thus ready for the ride to start. The platform 10 and the individual platforms 11 can rotate. In this operating state the individual watercrafts 20 seem to float on the water surface 4. In order to end this operating state, i.e. stopping the ride, the platform 10 including the individual platforms 11 are lifted to such an extent that they project beyond the water level 4; the water amusement ride assumes its idle state. In order to allow performing this task, the platform 10 is arranged on a platform carrier 50 embodied as a turret 36. This platform carrier 50 is also discernible from FIG. 1. The platform carrier 50 is lifted and/or lowered e.g. by a lifting device already known from DE 10 2009 053 439 A1. It is supported with wheels on the base 3, so that the entire mechanism comprising platform carrier 50, the platform 10, the individual platforms 11 and the watercrafts 20 can rotate in the lowered state.

Figure 4:
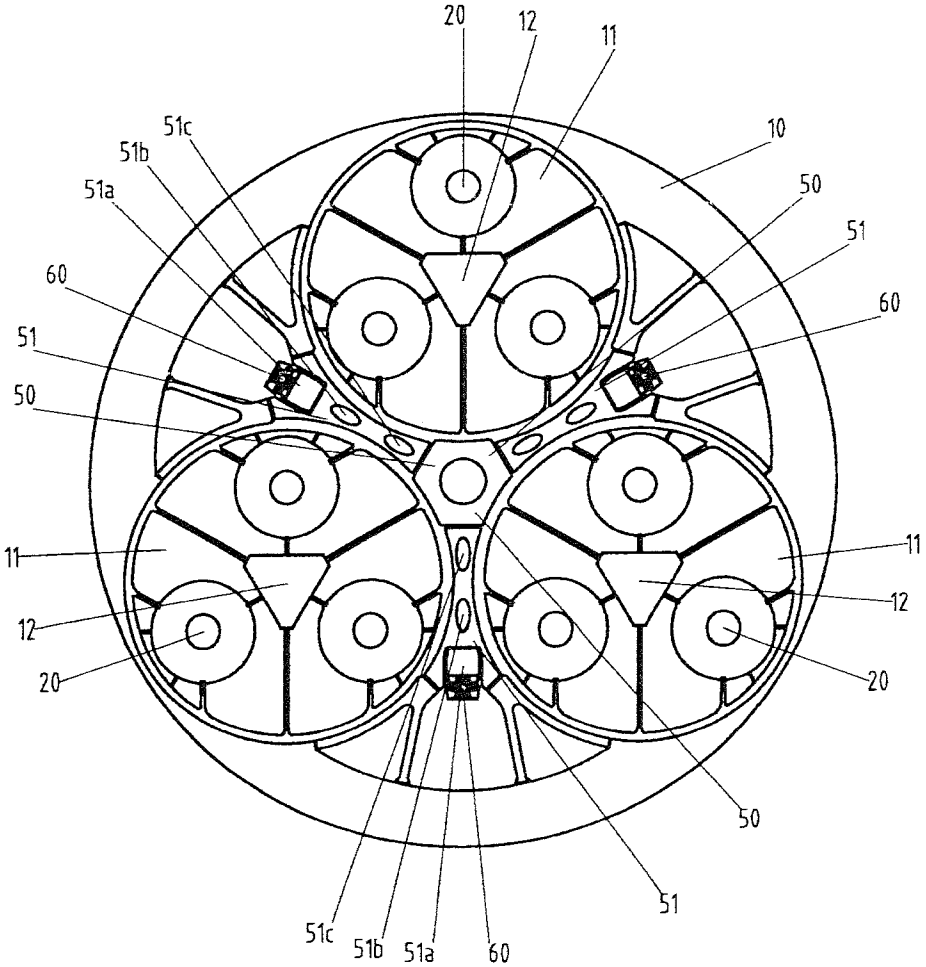
FIG. 4 is a line drawing evidencing a transparent, perspective view of an example of a rotational water amusement ride according to the invention.

FIG. 4 shows, in a largely abstract form, a similar, rotational and circular platform 10 with three also preferably rotational individual platforms 11 and located thereon respectively three watercrafts 20. In the center of the water amusement ride 1 once more a platform carrier 50 is located, which is now, however, designed especially such that it comprises a preferably metal construction in a stellar shape provided with a hollow chamber. This hollow chamber causes the buoyancy of the platform carrier 50 and thus serves as the floating body 55.

In the exemplary embodiment shown in FIG. 4 the stellar platform carrier 50 is equipped with three platform carrier arms 51 arranged at an angle of 120° in reference to each other, each of which engages between the three individual platforms 11. The three platform carrier arms 51 of the platform carrier 50 arranged in a stellar fashion, starting from their respective end, each show several, here concretely three hollow chambers 51*a*, 51*b*, 51*c* open towards the top, all of which are filled with air. In the illustration of FIG. 4 the hollow chambers 51*a*, 51*b*, 51*c* of the platform carrier 50 are shown open towards the top. When these hollow chambers 51*a*, 51*b* and 51*c* also remain open towards the top when the water amusement ride is in operation, it must be ensured that any lowering of the platform carrier 50 together with the platform 10 occurs only to such an extent that no water can flow from the top into the hollow chambers 51*a*, 51*b*, 51*c*. However, in general it is also possible that the hollow chambers 51*a*, 51*b*, 51*c* are covered towards the top, for example, with a suitable plate or also with a decorative material of the water amusement ride 1 so that they affect the desired buoyancy when it is submerged in water.

As discernible from FIG. 4, particular drive devices 60 are placed in the exterior hollow chambers 51*a* of the individual platform carrier arms 51 of the platform carrier 50, which are explained in greater detail in the following in the context with FIG. 5. Overall, such drive devices 60 are placed in each exterior hollow chamber 51*a* of the three platform carrier arms 51 of the platform carrier 50, which on the one hand are provided for raising the platform carrier 50 itself, and on the other hand also for distorting the entire platform 10 as well as the individual platforms 11. This is explained in greater detail in the following.

Figure 4B:
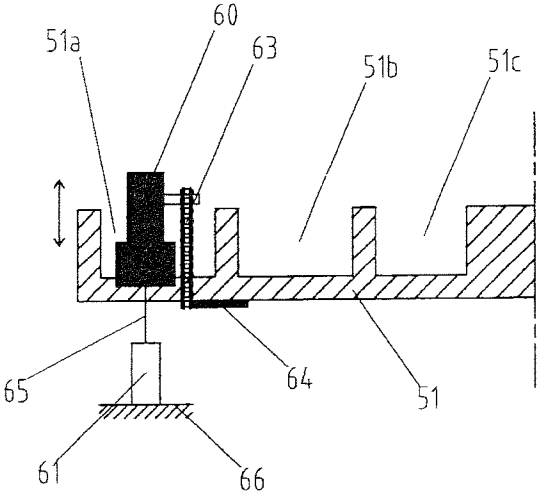
FIGS. 4*a*, 4*b* are line drawings evidencing details of cross-sections regarding FIG. 4.
Figure 4A:
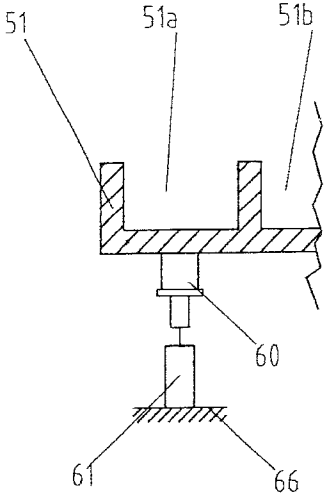

As shown in FIG. 4*a* in a cross-section, a drive device 60 is placed in the exterior hollow chamber 51*a*, which represents an electromotive drive device 60. This electromotive drive device 60 comprises a hoisting engine like a forklift, by which the lifting arms 64 engage under the platform carrier arm 51 in order to allow lifting it and also lowering it. The lowering may also occur based on the own weight of the entire arrangement. The drive device 60 is supported via a suitable axle 65 with a running wheel 61 on the base 66 of the water amusement ride 1. Via another electromechanical and/or electromotive drive device 60, not shown in FIG. 4*a*, the running wheel 61 and thus the platform carrier 50 and ultimately therefore the water amusement ride 1 can be set into rotation.

Instead of the drive device 60 sketched in FIG. 4*a*, which operates like a forklift and engages under the platform carrier arms 51, it is also possible to provide a hydraulic drive device as the drive device 60, as sketched in FIG. 4*b*. This hydraulic drive device 60 comprises a lifting cylinder, which at its upper end engages the platform carrier 50 and/or the platform carrier arm 51 of the platform carrier 50 and on the other end is coupled to the above-mentioned running wheel 61. The running wheel 61 itself is driven in turn by an electromotive unit, which is not shown in FIG. 4*b*, in order to set the water amusement ride 1 into rotation.

It is self-evident that the platform carrier 50 and particularly the exterior hollow chamber 51*a* with the drive device 60 located therein is designed such that the platform carrier 50 can be raised, while the drive device 60 is supported on the base 66 of the water amusement ride 1.

As particularly discernible from the sectional illustration of FIG. 4*a*, the hollow chambers 51*b* and 51*c* and also the hollow chamber 51*a* are embodied as floating bodies, because they are entirely and/or partially filled with air and this way increase the buoyancy of the platform carrier 50.

By providing one and/or several such hollow bodies 51, 51*b*, 51*c* and/or floating bodies 55 in the platform carrier 50 the buoyancy of the entire arrangement can be influenced in a targeted fashion in order to effectively release the lifting device, thus to effectively reduce the force to be provided by the lifting device.

As shown in FIG. 4, the individual platforms 11 in turn are provided with an individual platform carrier 12 in the center of the respective individual platforms 11. In the exemplary embodiment shown in FIG. 4 these individual platform carriers 12 show a triangular shape when seen from above, and extend into the depth such that these individual platform carriers 12 are also submerged when the platform 10 is in the lowered state. These individual platform carriers 12 may show also a floating body, for example by being embodied entirely or partially with hollow walls and this way forming a floating body.

Furthermore, it is easily possible, although not shown in FIG. 4, to place one or more floating bodies in the construction of the platform 10 itself, which can also be submerged, if applicable.

The floating body or bodies 55 of the platform 10 and perhaps the floating body or bodies 12 of the individual platforms 11 facilitate with their buoyancy the raising of the entire arrangement out of the water. The buoyancy generated by the floating bodies 55 allows during the change into the idle state to raise the platform carrier 50 including the platform 10 and the individual platforms 11 with lower energy consumption and within a shorter period of time, compared to the water amusement rides of prior art.

Figure 5:
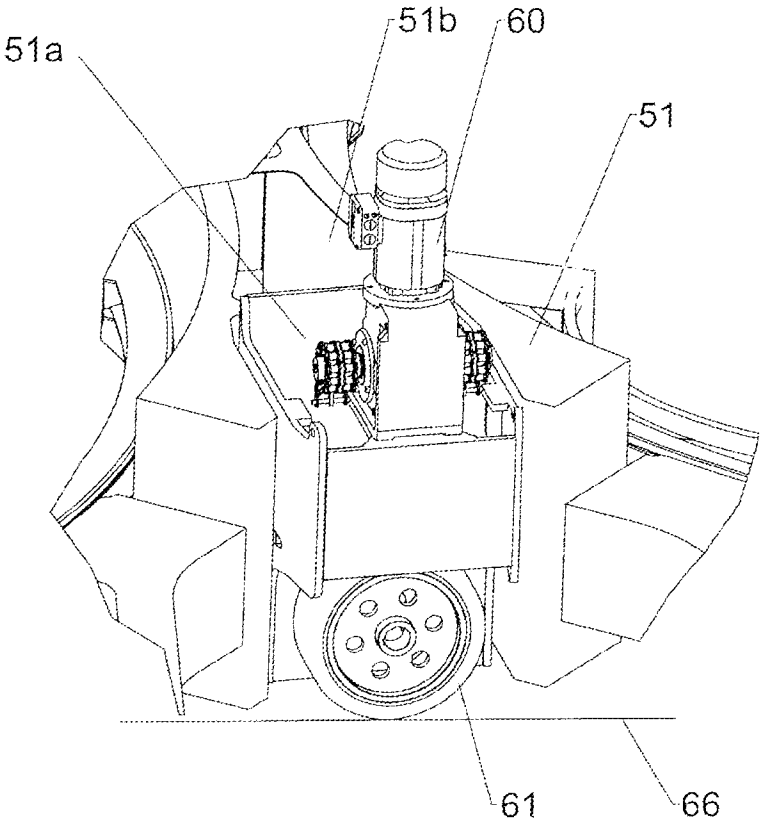
FIG. 5 is a line drawing evidencing a detail of a platform carrier of FIG. 4 in a side view.

FIG. 5 shows a vertical cross-section through the arrangement shown in FIG. 4 (cf. here the sectional line V-V) in the area of one of the three drive devices 60 located at the exterior end in the hollow chamber 51*a* of the platform carrier 50. This drive device 60 represents an electromotive drive unit, which on the one hand serves to raise the platform carrier 50—and thus also the entire platform 10 —as well as setting into rotation the platform carrier 50. The drive device 60 is located for this purpose, as already mentioned in the context with FIG. 4*a*, in an external hollow chamber 51*a* at the external end of a platform carrier arm 51 of the platform carrier 50. The hollow chamber 51*a* is here designed such that a running wheel 61 is placed underneath the hollow chamber 51*a*, which in case of an intended distortion of the platform carrier 50 and thus the platform 10 is driven by the drive device 60. For this purpose the running wheel 61 rests on a base 66 of the water amusement ride 1. The same applies for the other two drive devices 60, not shown in FIG. 5.

Any raising of the platform 10 is easily possible with this drive device 60, since the drive device 60 is equipped with suitable means for raising the platform carrier 50. For this purpose, the drive device 60 shows means which allow an axial adjustment of the coupling elements along an axis 65, which for example is fixed at the platform carrier 50 or which engages under at least the platform carrier 50, e.g. like a forklift. However, it is also possible that other drive devices are used in order to set into motion the platform 10 on the one side and to raise it on the other side. Suitable drive devices for this purpose are, for example, stated in DE 10 2009 053 439 A1 of the applicant, mentioned at the outset.

As mentioned, the hollow chamber 51*a*, in which the drive device 60 is placed, is designed open towards the top, thus embodied like a trough. Due to the fact that the hollow chamber 51*a* is open towards the top, it is possible to integrate the entire vertical guiding technology and the drive electronic in a dry and maintenance-friendly environment. The drive devices 60 act like cams for the platform 10 and/or the individual platforms 11, however, they always rest with a defined weight on the base of the water amusement ride 1, preferably on a running board mounted thereon. In order to increase this support weight when the water amusement ride 1 is started up and slowed down and in order to compensate the inertia effects of the water during the acceleration and deceleration process, preferably the complete construction including persons, decorations, etc., except for the central axle, is pulled up at the drive devices 60. With this technology the friction value at the running wheel 61 is increased in a targeted fashion only when the torque is higher. For the rotation between the start-up and the deceleration the system stress reduces accordingly. The maneuver load is limited in this technology, comprising floating bodies and drive devices acting like cams, to approx. ⅕ of the normal load, thus the load which would be given without these floating bodies and/or hollow chambers 51*a*, 51*b*, 51*c*. This saves energy and time and accordingly protects the components involved. Additionally, such an arrangement is also very maintenance-friendly, because e.g. the complete drive device 60 with a vertical guide can be lifted off via a crane without any problems through the top when the water basin is filled.

FIG. 6 shows a detail of a different example of a platform carrier 50, which is embodied as an H-beam in its cross-section. In this part of the platform carrier 50 (as well as its remaining part), several floating bodies 55 are integrated, i.e. they are arranged inside the platform carrier 50. Thus, the platform carrier 50 acts here overall as a type of floating body. The floating bodies 55 may show an arbitrary shape for their body, such as a sphere, as indicated in FIG. 6, or be cubic, or may show an ellipsoid cross-section.

FIG. 7 shows a detail of the platform 10. Several floating bodies 55 are integrated in the platform 10, i.e. they are arranged inside the platform 10. The floating bodies 55 may show an arbitrary shape of their bodies, such as spherical, as indicated in FIG. 7, cubical or also show an ellipsoid cross-section, as also indicated in FIG. 7. According to the invention the individual platforms 11 may also show such an arrangement of floating bodies 55. This is indicated by the additional disclosure of the reference character 11 in FIG. 7.

One embodiment of the water amusement ride according to the invention is particularly advantageous, in which the floating bodies 55 and/or the additional floating bodies 55 are embodied such that they can be submerged, beneficially under water. Such submerging leads to the consequence that the above-mentioned buoyancy during submerging of the floating bodies 55 and/or the additional floating bodies is waived. In this case, when it is changed from the idle state to the operating state, the platform carrier 50 including the platform 10 and the individual platforms 11 can be lowered considerably faster than in an unsubmerged state of the (perhaps additional) floating bodies 55. Such a submersible floating body 55 is shown in FIG. 8: the floating body 55 illustrated here shows a section for the input of e.g. water (and also for pumping out the water), which can be blocked off; this is indicated schematically in FIG. 8 at the right edge of the floating body 55.

Figure 9:
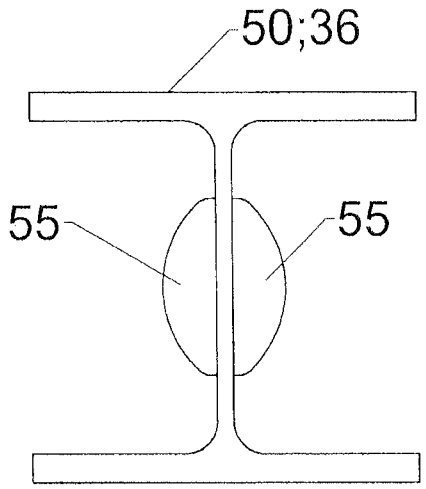
FIGS. 9 and 10 are line drawings evidencing alternative details of illustrations of the platform carrier and a platform and/or an individual platform including the corresponding floating bodies.
Figure 10:
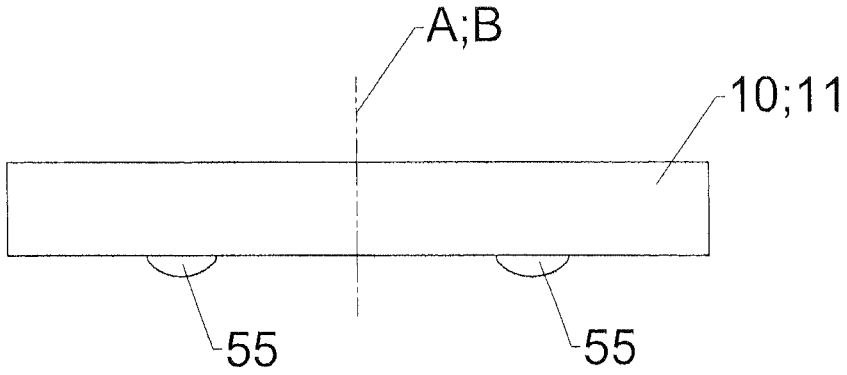

FIGS. 9 and 10 show the platform carrier 50 and the platform 10 and/or one of the individual platforms 11 each in a lateral top view (in case of the platform carrier 50, however, representative for the entire platform carrier 50, only one end of the rotary turret 36 is shown). In these embodiments of the water amusement ride according to the invention, the (perhaps additional) floating bodies 55 are not an integral component of the platform carrier 50 and/or the platform 10 and/or the individual platforms 11, but each connected thereto as separate parts, e.g. via adhesion, welding, riveting or also via other connection technologies. This is also shown in a largely schematic fashion.

By the entire number and/or size of the floating bodies as well as submersing or exposing the floating bodies, the overall buoyancy of the rotary water amusement ride can be influenced in any desired direction. Thus, both the dynamic during the change from the idle state into the operating state of the water amusement ride can be influenced as well as inversely a desired behavior of the water amusement ride can be adjusted, as well as the savings of necessary energy that can be achieved here. Furthermore, via the present invention even greater acceleration and deceleration values of the water amusement ride can be transmitted.

LIST of REFERENCE NUMBERS

1 Water amusement ride
2 Frame
3 Base
4 Water level, water surface
10 Platform
11 Individual platform
12 Individual platform carrier
20 Watercraft
21 Seat
22 Spray gun
23 Floating body
24 Recess
36 Turret
50 Platform carrier
51 Platform carrier arm
51*a* Hollow chamber
51*b* Hollow chamber
51*c* Hollow chamber
55 Floating body, additional floating body, hollow chamber
60 Drive device
61 Running wheel
63 Chain
64 Lifting arm
65 Axis, axle
66 Base
A Axis of rotation of the platform
B Axis of rotation of the individual platform
X Axis of the water amusement ride
P Arrow
Z Direction of motion
V-V Section The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

I claim:

1. A water amusement ride with several watercraft, which are mobile in a body of water and each of which shows space to accommodate passengers, comprising a platform, rotational around an axis perpendicular to a water surface, which in the idle state of the water amusement ride is raised above the water surface and which in an operating state is rotationally movable around said axis and at least partially below the water surface, and comprises a platform carrier, by which the platform can be lifted above the water surface, wherein the platform carrier and the platform collectively are equipped with at least one buoyancy element or floating body which, in said operating state, is also rotationally movable around said axis.

2. The water amusement ride of claim 1, wherein the platform is rotational.

3. The water amusement ride of claim 1, wherein the platform carrier has integrated hollow chambers, which serve as buoyancy elements or floating bodies.

4. The water amusement ride of claim 1, further comprising wherein individual platforms are arranged on the platform, which are equipped with additional buoyancy elements or floating bodies.

5. The water amusement ride of claim 1, wherein at least one of the buoyancy elements or floating bodies can be submersed.

6. The water amusement ride of claim 1, wherein at least one of the additional floating bodies is arranged at an individual platform.

7. The water amusement ride of claim 1, wherein the platform carrier is embodied in a stellar or crosswise fashion with one or more platform carrier arms.

8. The water amusement ride of claim 7, further comprising wherein a drive device is arranged at or in each platform carrier arm at the end.

9. The water amusement ride of claim 8, wherein the drive device is arranged in a hollow chamber of the platform carrier arm.

10. The water amusement ride of claim 1, wherein the water amusement ride comprises an electromotive and/or hydraulic drive device for raising the platform.

11. A drive device for a particular rotary water amusement ride of claim 1, further comprising wherein several drive devices are provided, each of which being arranged at one end of the platform carrier arm of the platform carrier.

12. The drive device of claim 11, wherein the drive devices are each arranged in a hollow chamber of a platform carrier arm at its respective end.

13. The drive device of claim 11, wherein the drive devices are electromechanical or hydraulic drive devices.

14. A water amusement ride with several watercraft, which are mobile in a body of water and each of which shows space to accommodate passengers, comprising a platform to which several individual platforms are coupled and which individual platforms are rotationally mobile around an axis perpendicular to a water surface, which in an idle state of the water amusement ride are raised above the water surface and which, in an operating state, are rotationally movable about said axis and at least partially below the water surface, and comprises a platform carrier by which any combination of the individual platforms and the platform can be lifted above the water surface, wherein the platform carrier, the platform and the individual platforms are equipped with at least one buoyancy element or floating body, which, in said operating state, is also rotationally movable about said axis.

* * * * *